US008226018B2

(12) United States Patent
Magel

(10) Patent No.: US 8,226,018 B2
(45) Date of Patent: Jul. 24, 2012

(54) FUEL INJECTOR

(75) Inventor: Hans-Christoph Magel, Reutlingen (DE)

(73) Assignee: Robert Bosch GmbH, Stuttgart (DE)

( * ) Notice: Subject to any disclaimer, the term of this patent is extended or adjusted under 35 U.S.C. 154(b) by 107 days.

(21) Appl. No.: 12/520,279

(22) PCT Filed: Oct. 23, 2007

(86) PCT No.: PCT/EP2007/061323

§ 371 (c)(1),
(2), (4) Date: Jun. 19, 2009

(87) PCT Pub. No.: WO2008/077657

PCT Pub. Date: Jul. 3, 2008

(65) Prior Publication Data

US 2009/0308956 A1 Dec. 17, 2009

(30) Foreign Application Priority Data

Dec. 22, 2006 (DE) ..... 10 2006 062 216

(51) Int. Cl.

| | |
|---|---|
| ***F02M 47/02*** | (2006.01) |
| ***F02M 61/20*** | (2006.01) |
| ***F02M 51/00*** | (2006.01) |
| ***B05B 1/30*** | (2006.01) |

(52) U.S. Cl. ..... 239/533.9; 239/88; 239/533.2; 239/584; 239/585.1; 239/585.5

(58) Field of Classification Search ..... 239/88, 239/89, 90, 91, 92, 533.2, 533.3, 533.9, 584, 239/585.1, 585.2, 585.3, 585.4, 585.5
See application file for complete search history.

(56) References Cited

U.S. PATENT DOCUMENTS

| | | | | |
|---|---|---|---|---|
| 4,576,338 | A * | 3/1986 | Klomp | 239/452 |
| 5,779,149 | A * | 7/1998 | Hayes, Jr. | 239/124 |
| 5,860,597 | A * | 1/1999 | Tarr | 239/124 |
| 6,213,098 | B1 | 4/2001 | Kato et al. | |
| 6,824,081 | B2 * | 11/2004 | Peters et al. | 239/533.2 |
| 2005/0116058 | A1 | 6/2005 | Magel | |
| 2007/0028895 | A1 | 2/2007 | Fujii | |

FOREIGN PATENT DOCUMENTS

| | | | |
|---|---|---|---|
| DE | 10218546 | A1 | 11/2002 |
| DE | 102006000021 | A1 | 8/2006 |
| EP | 1081372 | B1 | 10/2004 |
| WO | 2004003737 | A2 | 1/2004 |

* cited by examiner

*Primary Examiner* — Len Tran
*Assistant Examiner* — Ryan Reis
(74) *Attorney, Agent, or Firm* — Ronald E. Greigg

(57) ABSTRACT

The invention relates to a fuel injector with an injector housing which has a high-pressure fuel connection which is connected to a central high-pressure fuel source outside the injector housing, and with a pressure chamber within the injector housing. According to the pressure in a coupling chamber, fuel under a high pressure is injected from the pressure chamber into a combustion chamber of an internal combustion engine when a nozzle valve opens. The nozzle valve has a combustion chamber-remote end with a control pressure surface which is acted upon in the coupling chamber by the coupling chamber pressure. In order to create a fuel injector which can be produced inexpensively, the nozzle valve has at least one low-pressure surface which is averted from the combustion chamber and acted upon with low pressure.

20 Claims, 2 Drawing Sheets

FUEL INJECTOR

CROSS-REFERENCE TO RELATED APPLICATION

This application is a 35 USC 371 application of PCT/EP 2007/061323 filed on Oct. 23, 2007.

BACKGROUND OF THE INVENTION

1. Field of the Invention

The invention relates to a fuel injector.

2. Description of the Prior Art

It is known to use stroke-controlled fuel injectors to supply fuel in direct-injecting diesel engines. This has the advantage that the injection pressure can be adapted to the load and to the engine speed. The tiggering of injectors can be carried out by means of a piezoelectric actuator either directly or with the interposition of a servo-control chamber.

OBJECT AND SUMMARY OF THE INVENTION

The object of the invention is to create a fuel injector that is inexpensive to manufacture.

In a fuel injector that has an injector housing equipped with a high-pressure fuel connection that is connected to a central high-pressure fuel source outside the injector housing and to a pressure chamber inside the injector housing, from which, depending on the pressure in a coupling chamber, highly pressurized fuel is injected into a combustion chamber of an internal combustion engine when a nozzle needle opens, which nozzle needle has an end oriented away from the combustion chamber that is acted on by the coupling chamber pressure in the coupling chamber, the object is attained in that the nozzle needle or an element operatively connected to the nozzle needle has at least one low-pressure surface oriented away from the combustion chamber that is acted on by low pressure. The injector according to the invention can be operated with a pulling working phase and a pushing work phase. This offers the advantage that the size of an actuator used to actuate the injector, in particular a piezoelectric actuator, can be reduced in comparison to conventional injectors. The additional low-pressure surface, which is preferably situated at the upper end of the nozzle needle and faces away from the closing direction, reduces the opening force required to open the nozzle needle. Depending on the ratio of the size of the control pressure surface and/or combustion chamber pressure surface to the size of the low-pressure surface, when the nozzle needle is in the open state, a closing force is required in order to close the nozzle needle. According to the invention, the powerful opening force that occurs in conventional injectors is divided into the opening phase and closing phase of the nozzle needle. A division in the 50/50 range is particularly advantageous. The reduced opening force of the nozzle needle also reduces stiffness losses in the hydraulic and mechanical transmission elements. The nozzle needle can be embodied in one piece or be composed of multiple parts. The nozzle needle can also be operatively connected to an additional element. The additional element can be mechanically or hydraulically coupled to the nozzle needle.

A preferred exemplary embodiment of the fuel injector is characterized in that the low-pressure surface is smaller than a combustion chamber pressure surface provided at the combustion chamber end of the nozzle needle. The combustion chamber pressure surface is defined by a sealing seat provided at the end of the nozzle needle close to the combustion chamber. The pressure surface that is oriented toward the combustion chamber and delimited on the nozzle needle by the sealing seat is referred to as the combustion chamber pressure surface.

Another preferred exemplary embodiment of the fuel injector is characterized in that the low-pressure surface is approximately half the size of the combustion chamber pressure surface. As a result, the output capacity of an actuator used to actuate the injector, in particular a piezoelectric actuator, is optimally utilized and the required actuator size can be approximately halved.

Another preferred exemplary embodiment of the fuel injector is characterized in that the nozzle needle has a shoulder constituting the low-pressure surface at its end oriented away from the combustion chamber. The end of the nozzle needle oriented away from the combustion chamber is preferably embodied in the form of a straight, circular cylinder on which the shoulder is embodied. Viewed in cross section, the shoulder is embodied in the form of a step.

Another preferred exemplary embodiment of the fuel injector is characterized in that the shoulder is provided between a first guide section that extends away from the combustion chamber and a second guide section that extends toward the combustion chamber. The two guide sections constitute a double guide for the nozzle needle. Between its combustion chamber end and the double guide, the nozzle needle has another guide section that guides the nozzle needle in the injector housing.

Another preferred exemplary embodiment of the fuel injector is characterized in that the end of the nozzle needle oriented away from the combustion chamber is guided with the two guide sections in a double guide body that is embodied to be complementary to the guide sections. The double guide body is firmly attached to, preferably of one piece with, a part of the injector housing, for example an intermediate plate.

Another preferred exemplary embodiment of the fuel injector is characterized in that the double guide body has a shoulder into the vicinity of which a low-pressure conduit feeds. The low-pressure conduit is connected to a low-pressure source such as a fuel tank. The low-pressure conduit acts on the low-pressure surface with low pressure for example atmospheric pressure.

Another preferred exemplary embodiment of the fuel injector is characterized in that the double guide body is embodied in the form of a sleeve and is situated in a high-pressure chamber. The exertion of high pressure on the outside of the double guide body makes it possible to easily avoid an undesired splaying of the guides by the high system pressure. In addition, the loss quantities can be kept to a minimum.

Another preferred exemplary embodiment of the fuel injector is characterized in that the coupling chamber is delimited in the radial direction by the double guide body and in the axial direction toward the combustion chamber by the nozzle needle. The coupling chamber is delimited in the axial direction away from the combustion chamber by a coupler piston that is connected to an actuator, in particular a piezoelectric actuator.

Another preferred exemplary embodiment of the fuel injector is characterized in that the coupling chamber is divided into partial coupling chambers that are connected to each other via a throttle. This makes it possible to optimize the oscillation behavior of the injector. In addition, the needle opening speed can be controlled by means of the throttle.

BRIEF DESCRIPTION OF THE DRAWINGS

The invention will be described in further detail below in conjunction with the drawings, in which.

DESCRIPTION OF THE PREFERRED EMBODIMENTS

Figure 1:
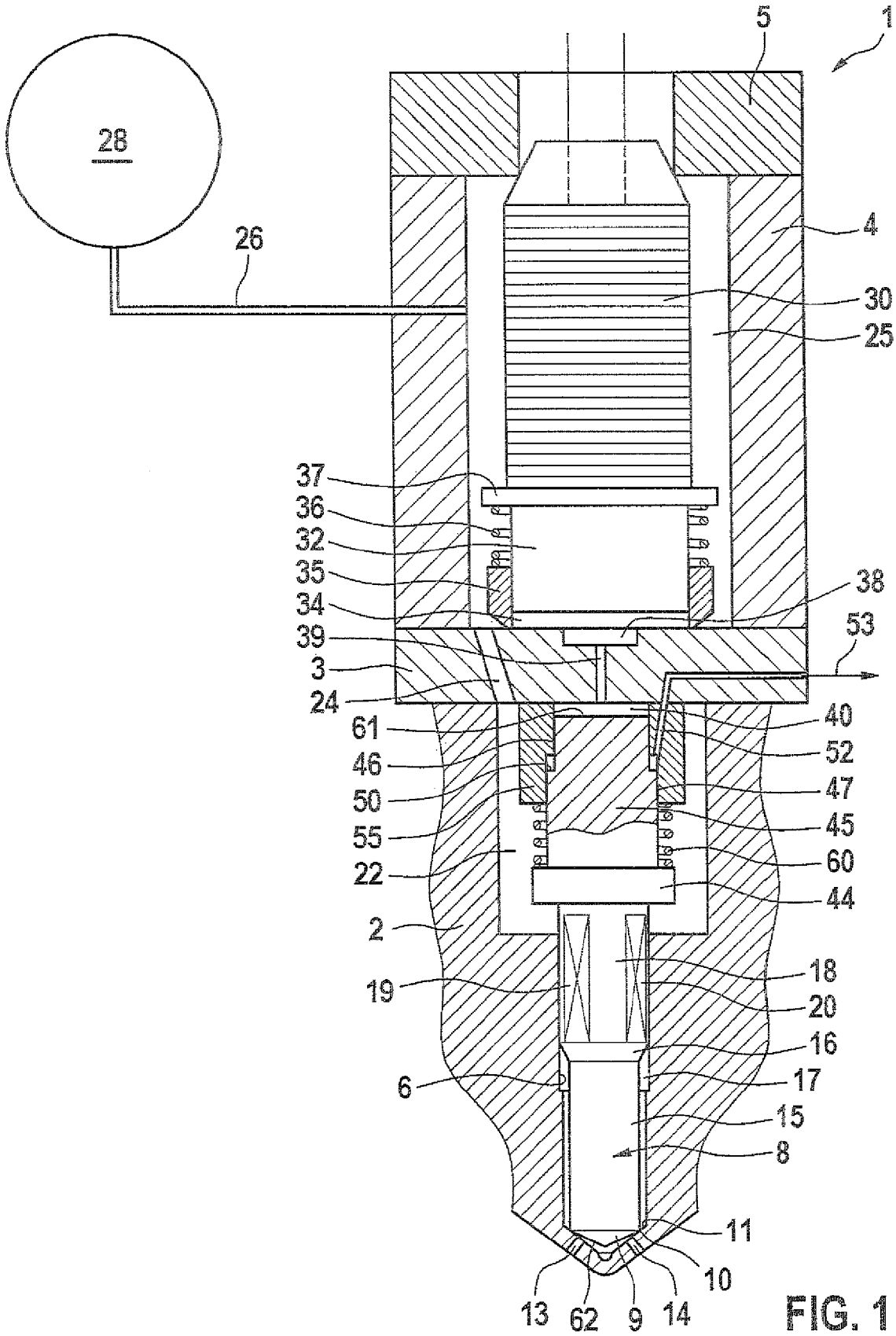
FIG. 1 is a simplified longitudinal section through a fuel injector according to the invention and FIG. 2 is a force/stroke graph in which the working lines of an actuator of the fuel injector are schematically depicted.

FIG. 1 is a longitudinal section through a fuel injector with an injector housing 1. The injector housing 1 includes a nozzle body 2, which protrudes with its lower free end into a combustion chamber of an internal combustion engine to be supplied with fuel. With its upper end surface oriented away from the combustion chamber, the nozzle body 2 is clamped by means of a retaining nut (not shown) against an intermediate body 3 and an injector body 4. The injector body 4 is embodied essentially in the form of a circular, cylindrical sleeve whose one end surface is closed by the intermediate body 3 and whose other end surface is closed by an injector head 5.

The nozzle body 2 has an axial guide bore 6 let into it, in which a nozzle needle 8 is guided in an axially movable fashion. A sealing edge 10 is embodied at the tip 9 of the nozzle needle 8 and cooperates with a sealing seat or sealing surface 11 in order to selectively open or close two injection ports 13 and 14 as a function of the position of the nozzle needle 8. When the nozzle needle tip 9 with the sealing edge 10 lifts away from its sealing seat, then highly pressurized fuel is injected through the injection ports 13 and 14 into the combustion chamber of the internal combustion engine.

Leading away from the tip 9, the nozzle needle 8 has a pressure chamber section 15, which is followed by a section 16 that widens out in the form of a truncated cone, which is also referred to as a pressure shoulder 16. The pressure shoulder is situated in a pressure chamber 17 that is embodied between the nozzle needle 8 and the nozzle body 2. The pressure shoulder 16 is followed by a guide section 18 that is guided so that it is able to move back and forth in the guide bore 6. Flattened regions 19, 20 in the guide section 18 provide a fluid connection between the pressure chamber 17 and a high-pressure chamber 22.

The high-pressure chamber 22 is connected via a connecting conduit 24 that is embodied in the intermediate body 3 to an actuator chamber 25, which in turn is connected via a supply conduit or supply line 26 to a high-pressure fuel source 28 that is also referred to as a common rail. The fuel injector is actuated by a piezoelectric actuator 30 equipped with a coupler piston 32 whose combustion chamber end surface delimits a partial coupling chamber 34 in the axial direction. In the radial direction, the partial coupling chamber 34 is delimited by a sealing sleeve 35 that is guided on the coupler piston 32 and is clamped in place by a compression spring 36 that is supported against a collar 37 of the coupler piston 32. The partial coupling chamber 34 is connected via a connecting conduit 98 equipped with a throttle 39 to another partial coupling chamber 40.

The guide section 18 of the nozzle needle 8 is delimited at the end oriented away from the combustion chamber by a collar 44 from which the end 45 of the nozzle needle 8 oriented away from the combustion chamber extends. The end 45 of the nozzle needle 8 oriented away from the combustion chamber has a first guide section 46 and a second guide section 47. The first guide section 46 has a smaller outer diameter than the second guide section 47 that extends from the collar 44. The two guide sections 46 and 47 are connected to each other by means of a shoulder 50 that includes a low-pressure surface.

The end 45 of the nozzle needle 8 oriented away from the combustion chamber is guided with its guide sections 46 and 47 in a double guide body 55 that is affixed to the intermediate body 3, which is also referred to as an intermediate plate. The intermediate body 3 and the double guide body 55 have a pressure connection conduit 52 let into them, which in the vicinity of the shoulder 50, feeds into an annular chamber that is embodied between the double guide body 55 and the end 45 oriented away from the combustion chamber. An arrow 53 indicates that the low-pressure connection conduit 52 is connected to a low-pressure source such as a fuel tank.

The double guide body 55 is embodied in the form of a sleeve that extends from the intermediate body 3 toward the combustion chamber. A nozzle spring 60 is clamped between the collar 44 and the end surface of the double guide body 55 oriented toward the combustion chamber. Like the double guide body 55, the nozzle spring 60 is situated in the high-pressure chamber 22, which is thus also referred to as a nozzle spring chamber.

The nozzle needle 8 is guided in the shaft in the nozzle body 2 by means of the guide section 18 and, at its end 45 oriented away from the combustion chamber, is guided in the double guide body 55 by means of the guide sections 46 and 47. The design of the low-pressure surface of the shoulder 50 depends on the needle seat 11 at the tip 9 of the nozzle needle 8 and constitutes part of a combustion chamber pressure surface 62 beneath the needle seat 11.

In the idle state of the fuel injector, high pressure, which is also referred to as rail pressure, prevails in the partial coupling chambers 34 and 40. The high-pressure acts on the end surface of the nozzle needle 8 oriented away from the combustion chamber. This end surface is also referred to as the control pressure surface 61. The nozzle needle 8, whose control pressure surface 61 is acted on with high pressure, is closed. In the idle state of the fuel injector, the piezoelectric actuator 30 is charged and assumes its maximum longitudinal expansion. In order to activate the fuel injector, the piezoelectric actuator 30 is switched into a currentless state and therefore contracts. The pressure in the partial coupling chambers 34 and 40 decreases and the nozzle needle opens, i.e. lifts away from its nozzle needle seat. Preferably, a needle stop is provided to limit the stroke.

The shoulder 50 that is acted on with low-pressure, which is also referred to as a pressure shoulder, reduces the switching force required to open the needle, preferably halving it. This offers the advantage that in comparison to conventional actuators, the piezoelectric actuator 30 only has to have approximately half the cross-sectional area in order to exert the force required to open the needle. Alternatively, it is also possible to use a higher, for example doubled, path multiplication and a shorter actuator. By contrast with conventional fuel injectors, in the open state, the nozzle needle 8 is not pressure-balanced, but is instead acted on by a force acting in the opening direction. The piezoelectric actuator 30 must exert this force in order to close the needle. Within one work cycle, the piezoelectric actuator 30 can exert the same tensile and compressive force. The embodiment of the injector according to the invention makes it possible to optimally utilize the work capacity of the actuator.

Figure 2:
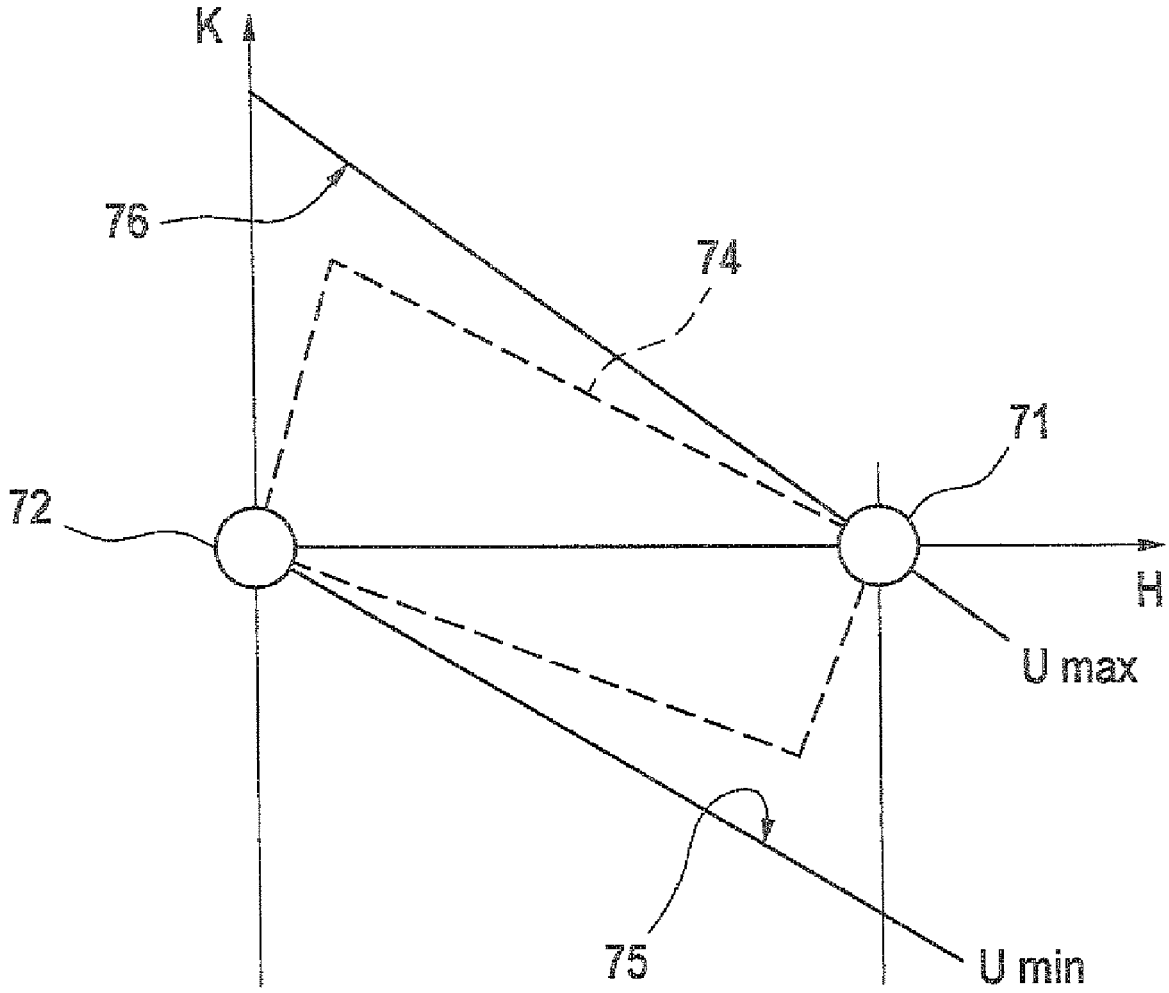

In FIG. 2, the force K is plotted over the stroke H in a Cartesian coordinate graph. A circle 71 represents the idle state of the injector in which the actuator assumes its maximum stroke. The second position or open position of the injector, in which the actuator assumes its minimum stroke, is labeled 72. A dashed tetragon 74 schematically depicts the working lines of the actuator 30 of the fuel injector shown in FIG. 1. The normal working range of conventional fuel injectors with direct needle control is indicated by a triangle 75. A triangle 76 indicates the expanded working range of the fuel injector according to the invention.

The foregoing relates to the preferred exemplary embodiments of the invention, it being understood that other variants and embodiments thereof are possible within the spirit and scope of the invention, the latter being defined by the appended claims.

The invention claimed is:

1. A fuel injector comprising an injector housing containing a nozzle needle movable between open and closed positions, a coupling chamber having a pressure therein, a pressure chamber, and a high-pressure fuel connection that is connected to a central high-pressure fuel source outside the injector housing and to the pressure chamber inside the injector housing, and depending on the pressure within the coupling chamber, highly pressurized fuel is injected from the pressure chamber into a combustion chamber of an internal combustion engine when the nozzle needle moves to its open position, wherein the nozzle needle has an end oriented away from the combustion chamber, which end has a pressure surface that is acted on by the pressure in the coupling chamber, and at least one low-pressure surface oriented away from the combustion chamber that is acted on by low pressure, wherein the end of the nozzle needle further has two guide sections of different diameters connected to each other by a shoulder, wherein the shoulder constitutes the low-pressure surface acted on by low pressure, and wherein the end of the nozzle needle oriented away from the combustion chamber is guided with the two guide sections in a double guide body situated in a high-pressure chamber between the injector housing and the end of the nozzle needle.

2. The fuel injector as recited in claim 1, wherein the low-pressure surface is smaller than a combustion chamber pressure surface provided at the combustion chamber end of the nozzle needle.

3. The fuel injector as recited in claim 1, wherein the low-pressure surface is approximately half the size of a combustion chamber pressure surface.

4. The fuel injector as recited in claim 2, wherein the low-pressure surface is approximately half the size of the combustion chamber pressure surface.

5. The fuel injector as recited in claim 1, wherein the two guide sections comprise a first guide section that extends away from the combustion chamber and a second guide section that extends toward the combustion chamber and the shoulder is provided between the first guide section and the second guide section.

6. The fuel injector as recited in claim 2, wherein the two guide sections comprise a first guide section that extends away from the combustion chamber and a second guide section that extends toward the combustion chamber and the shoulder is provided between the first guide section and the second guide section.

7. The fuel injector as recited in claim 3, wherein the two guide sections comprise a first guide section that extends away from the combustion chamber and a second guide section that extends toward the combustion chamber and the shoulder is provided between the first guide section and the second guide section.

8. The fuel injector as recited in claim 1, wherein the double guide body is embodied to be complementary to the two guide sections.

9. The fuel injector as recited in claim 2, wherein the double guide body is embodied to be complementary to the two guide sections.

10. The fuel injector as recited in claim 3, wherein the double guide body is embodied to be complementary to the two guide sections.

11. The fuel injector as recited in claim 8, wherein the double guide body has a shoulder into a vicinity of which a low-pressure conduit feeds.

12. The fuel injector as recited in claim 8, wherein the double guide body is embodied as a sleeve that is situated in the high-pressure chamber.

13. The fuel injector as recited in claim 9, wherein the double guide body is embodied as a sleeve that is situated in the high-pressure chamber.

14. The fuel injector as recited in claim 8, wherein the coupling chamber is delimited in a radial direction by the double guide body and in an axial direction toward the combustion chamber by the nozzle needle.

15. The fuel injector as recited in claim 9, wherein the coupling chamber is delimited in a radial direction by the double guide body and in an axial direction toward the combustion chamber by the nozzle needle.

16. The fuel injector as recited in claim 10, wherein the coupling chamber is delimited in a radial direction by the double guide body and in an axial direction toward the combustion chamber by the nozzle needle.

17. The fuel injector as recited in claim 1, wherein the coupling chamber is divided into partial coupling chambers that are connected to each other via a throttle.

18. The fuel injector as recited in claim 17, wherein one of the partial coupling chambers is delimited in an axial direction by a coupler piston that is connected to a piezoelectric actuator and in a radial direction by a sealing sleeve that is guided on the coupler piston and clamped in place by a compression spring supported against a collar of the coupler piston.

19. The fuel injector as recited in claim 14, wherein the coupling chamber is delimited in the axial direction away from the combustion chamber by a coupler piston that is connected to a piezoelectric actuator.

20. A fuel injector comprising an injector housing containing a nozzle needle movable between open and closed positions, a coupling chamber having a pressure therein, a pressure chamber, and a high-pressure fuel connection that is connected to a central high-pressure fuel source outside the injector housing and to the pressure chamber inside the injector housing, and depending on the pressure within the coupling chamber, highly pressurized fuel is injected from the pressure chamber into a combustion chamber of an internal combustion engine when the nozzle needle moves to its open position, wherein the nozzle needle has an end oriented away from the combustion chamber, which end has a pressure surface that is acted on by the pressure in the coupling chamber, and at least one low-pressure surface oriented away from the combustion chamber that is acted on by low pressure, wherein the end of the nozzle needle further has two guide sections of different diameters connected to each other by a shoulder, wherein the shoulder constitutes the low-pressure surface acted on by low pressure, wherein the coupling chamber is divided into partial coupling chambers that are connected to each other via a throttle, and wherein one of the partial coupling chambers is delimited in an axial direction by a coupler piston that is connected to a piezoelectric actuator and in a radial direction by a sealing sleeve that is guided on the coupler piston and clamped in place by a compression spring supported against a collar of the coupler piston.

* * * * *